US010874151B1

(12) United States Patent
Clark

(10) Patent No.: US 10,874,151 B1
(45) Date of Patent: Dec. 29, 2020

(54) WEARABLE COOLING SYSTEM

(71) Applicant: Joseph Clark, Philpot, KY (US)

(72) Inventor: Joseph Clark, Philpot, KY (US)

( * ) Notice: Subject to any disclaimer, the term of this patent is extended or adjusted under 35 U.S.C. 154(b) by 358 days.

(21) Appl. No.: 14/973,907

(22) Filed: Dec. 18, 2015

Related U.S. Application Data

(60) Provisional application No. 62/093,566, filed on Dec. 18, 2014.

(51) Int. Cl.
*A41D 13/005* (2006.01)

(52) U.S. Cl.
CPC .... *A41D 13/0053* (2013.01); *A41D 2600/202* (2013.01); *F25D 2400/26* (2013.01)

(58) Field of Classification Search
CPC ..... A41D 13/0025
See application file for complete search history.

(56) References Cited

U.S. PATENT DOCUMENTS 2,773,262 A 12/1956 Brouha et al.
3,804,086 A * 4/1974 Agnew ..... A41D 13/1209 128/202.19
4,162,764 A * 7/1979 Millsap ..... A41D 13/005 239/152
4,964,282 A * 10/1990 Wagner ..... A41D 13/0025 2/DIG. 1
5,421,326 A 6/1995 Rankin et al.
5,438,707 A 8/1995 Horn
5,533,354 A 7/1996 Pirkle
6,128,784 A 10/2000 Frank
2003/0045918 A1 3/2003 Turner et al.
2005/0055753 A1 3/2005 Horn

OTHER PUBLICATIONS

Vortex Cooling Vest. Product Listing [online]. Allegro, 2012 [retrieved on Sep. 8, 2014]. Retrieved from the Internet: http://www.westernsafety.com/allegro2006/allegropg8.html.
Vortex Cooling Vest #HCBV-VEST. Product Listing [online]. Chicago Protective, 2013 [retrieved on Sep. 8, 2014]. Retrieved from the Internet: http://www.westernsafety.com/chicagoprotective2013/cp2013pg1.html.
"UF's air-cooled football shoulder pads help combat heat illness". Article [online]. Joe Kays, 2005 [retrieved on Sep. 8, 2014]. Retrieved from the Internet: http://www.research.ufl.edu/publications/explore/v10n3/story4.html.

* cited by examiner

*Primary Examiner* — Steven B McAllister
*Assistant Examiner* — Elizabeth M. May
(74) *Attorney, Agent, or Firm* — Cramer Patent & Design, PLLC; Aaron R. Cramer

(57) ABSTRACT

A body cooling apparatus is configured for wear under an outer garment such as those worn by welders. The apparatus is constructed of cloth-covered air tubing which distributes a supply of received compressed air. The user wears the tubing harness much like a vest. When the harness is connected to a compressed air source, the compressed air is vented through the cloth-covered tubing to assist in cooling the user's body.

1 Claim, 4 Drawing Sheets

WEARABLE COOLING SYSTEM

RELATED APPLICATIONS

The present invention is a continuation of, was first described in, and claims the benefit of U.S. Provisional Application No. 62/093,566, filed Dec. 18, 2014, the entire disclosures of which are incorporated herein by reference.

FIELD OF THE INVENTION

The present invention relates generally to a body cooling apparatus configured for wear under an outer garment such as those worn by welders.

BACKGROUND OF THE INVENTION

Heat illnesses are common occurrences for those working in hot environments. Workers who are performing metal welding operations must not only deal with hot ambient temperatures, but also the heat generated by the welding operations themselves, as well as the fact that they are wearing heavy protective clothing. One (1) solution is that of a fan that blows air on the worker. However, such a solution is not practical for those performing gas metal arc welding (GMAW) in that the moving air will also disperse the inert or active gas around the welding gun. Should the worker just continue, they are subject to developing a heat related illness in just a short period of time. Muscle cramps (caused by loss of salt from heavy sweating) can lead to heat exhaustion (caused by dehydration) which can lead to heat-stroke (which can cause shock, brain damage, and death). Accordingly, there exists a need for a means by which workers engaged in welding operations can be kept cool, thus avoiding potentially dangerous medical situations. The use of the pressurized air welder cooling system provides those engaged in welding operations in a hot work environment a means of keeping cool in a discrete manner that is quick, easy, and effective.

SUMMARY OF THE INVENTION

It is therefore an object of the present invention to provide such a personal cooling apparatus that is capable of being worn by a user who performs such tasks either in or creating a work environment with elevated temperature conditions. Such a cooling apparatus includes a pair of flexible cooling tubes capable of being worn as a vest by a user. The cooling tubes are connected to each other via a shoulder strap that can be adjustable. The cooling tubes have a pair of distal ends that are each attached to a manifold capable of being adapted to an air delivery system. Each tube has a plurality of apertures that permit the passage of air generated by the air delivery system onto or adjacent to the user when the device is worn.

Another object of the present invention is to provide such a manifold having main line, a first tee fitting attached to the main line and a first cooling tube, and a second tee fitting attached to the main line and a second cooling tube.

Another object is to provide an equidistant spacing between adjacent apertures to help ensure even delivery and cooling of the user when the apparatus is worn.

Yet another object is to provide a supply line to provide fluid communication between the air delivery system and the manifold. Such a supply line is also flexible and has an air flow control valve and an adapter at the opposite end from the manifold.

Another object is to provide a means to removably attach the supply line to either one of the tubes to retain the supply line and reduce any accidental snagging or catching of the supply line on something and risk inadvertent detachment from either the manifold or the air delivery system.

Yet another object of the apparatus is to provide a pair of sleeves that are each capable of removable attachment to one of the cooling tubes. In a preferred embodiment, the sleeves are slightly less in the length than the cooling tubes. In a preferred embodiment, the sleeves are a mesh material to enable reduced restriction of the passage of air through the apertures.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
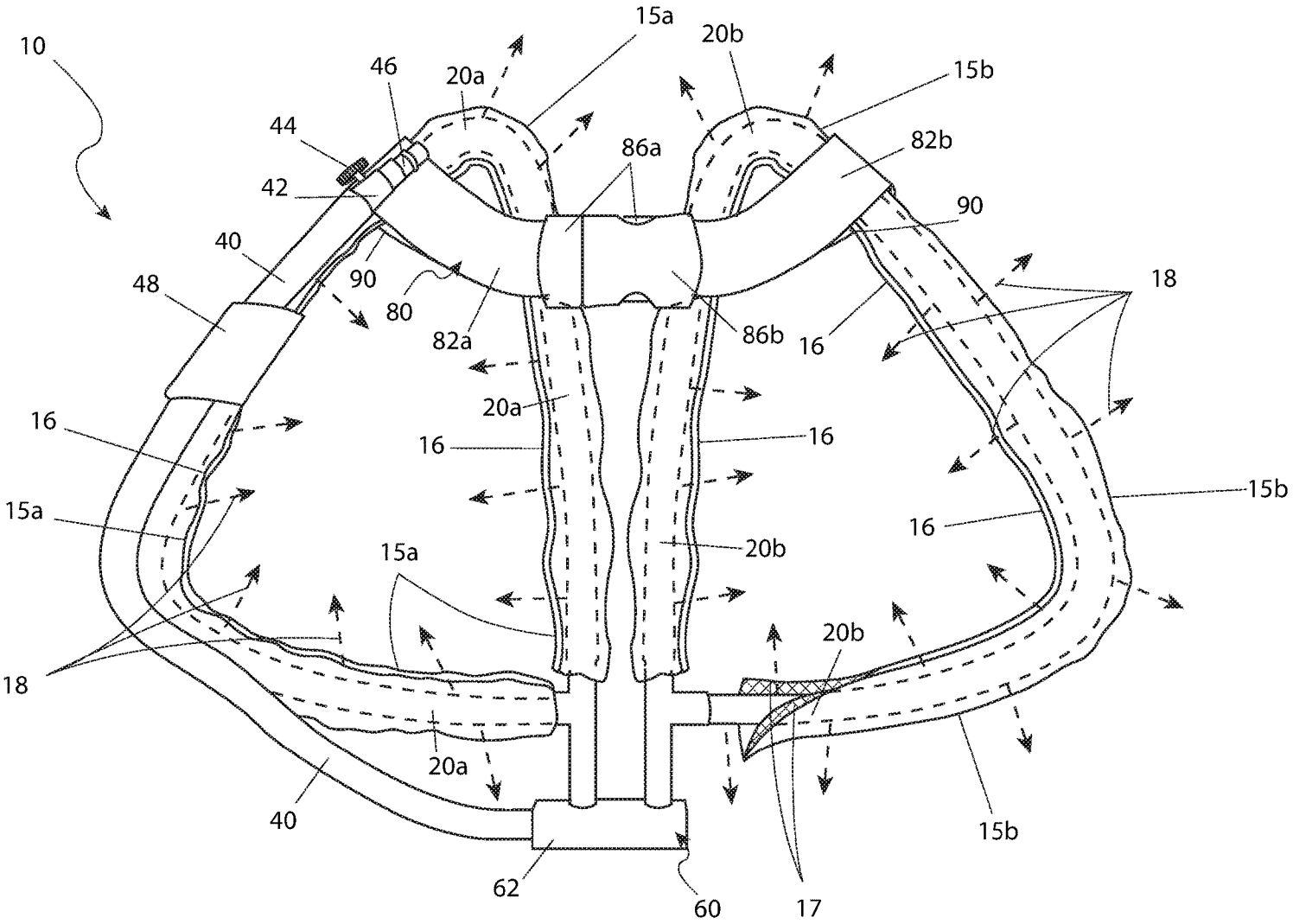
FIG. 1 is a front perspective view of a personal cooling apparatus 10, according to a preferred embodiment of the present invention.

10 personal cooling apparatus
15*a* first sleeve section
15*b* second sleeve section
16 seam
17 hook-and-loop fastener
18 air flow
20*a* first cooling tube
20*b* second cooling tube
22 tube aperture
24 tube end
40 air hose
42 valve
44 knob
45 hose attachment end
46 adapter
48 wrap fastener
60 manifold
62 body
64 air hose fitting
66*a* first "T" fitting
66*b* second "T" fitting
68*a* first tube fitting

68*b* second tube fitting
80 shoulder strap assembly
82*a* first strap
82*b* second strap
86*a* first buckle portion
86*b* second buckle portion
90*a* first strap loop
90*b* second strap loop
92 stitching
100 user
110 outer garment
120 air supply line

DETAILED DESCRIPTION OF THE PREFERRED EMBODIMENT

The best mode for carrying out the invention is presented in terms of its preferred embodiment, herein depicted within FIGS. 1 through 4*d*. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one (1) of the referenced items.

The present invention describes a personal cooling apparatus (herein described as the "apparatus") 10, which provides loops of cooling tubing 20*a*, 20*b* contained within respective open mesh sleeve sections 15*a*, 15*b* to be worn beneath a user's 100 outer garments 110 which deliver a cooling air flow 18. The apparatus 10 is placed beneath the user's 100 outer garment 110 and positioned about their back and side areas, being worn much like a vest. The apparatus 10 is designed to keep workers such as welders, foundry workers, and the like, cool while performing their duties in elevated ambient temperatures via introduction of a cool air flow 18 from a compressed air source 120.

Referring now to FIG. 1, a front perspective view of the apparatus 10, according to the preferred embodiment of the present invention, is disclosed. The apparatus 10 provides at least two (2) loops of cooling tubing 20*a*, 20*b*, shown here forming mirror-image first cooling tube 20*a* and second cooling tube 20*b* portions, covered by a respective first sleeve section 15*a* and a second sleeve section 15*b* portions. The cooling tubes 20*a*, 20*b* are envisioned to be made using similar lengths of a stock flexible plastic or rubber tubing having a plurality of equally-spaced tube apertures 22 being molded-in or punched through. The tube apertures 22 are arranged along external surfaces, each being approximately one-quarter of an inch (¼ in.) in diameter and arranged approximately one inch (1 in.) apart along an entire length of each tube 20*a*, 20*b*. The sleeve sections 15*a*, 15*b* are to be of an open-mesh design, thereby gently diffusing and distributing an air flow 18 released from the tube apertures 22 out into a user's 100 outer garments 110 to provide cooling.

Figure 2:
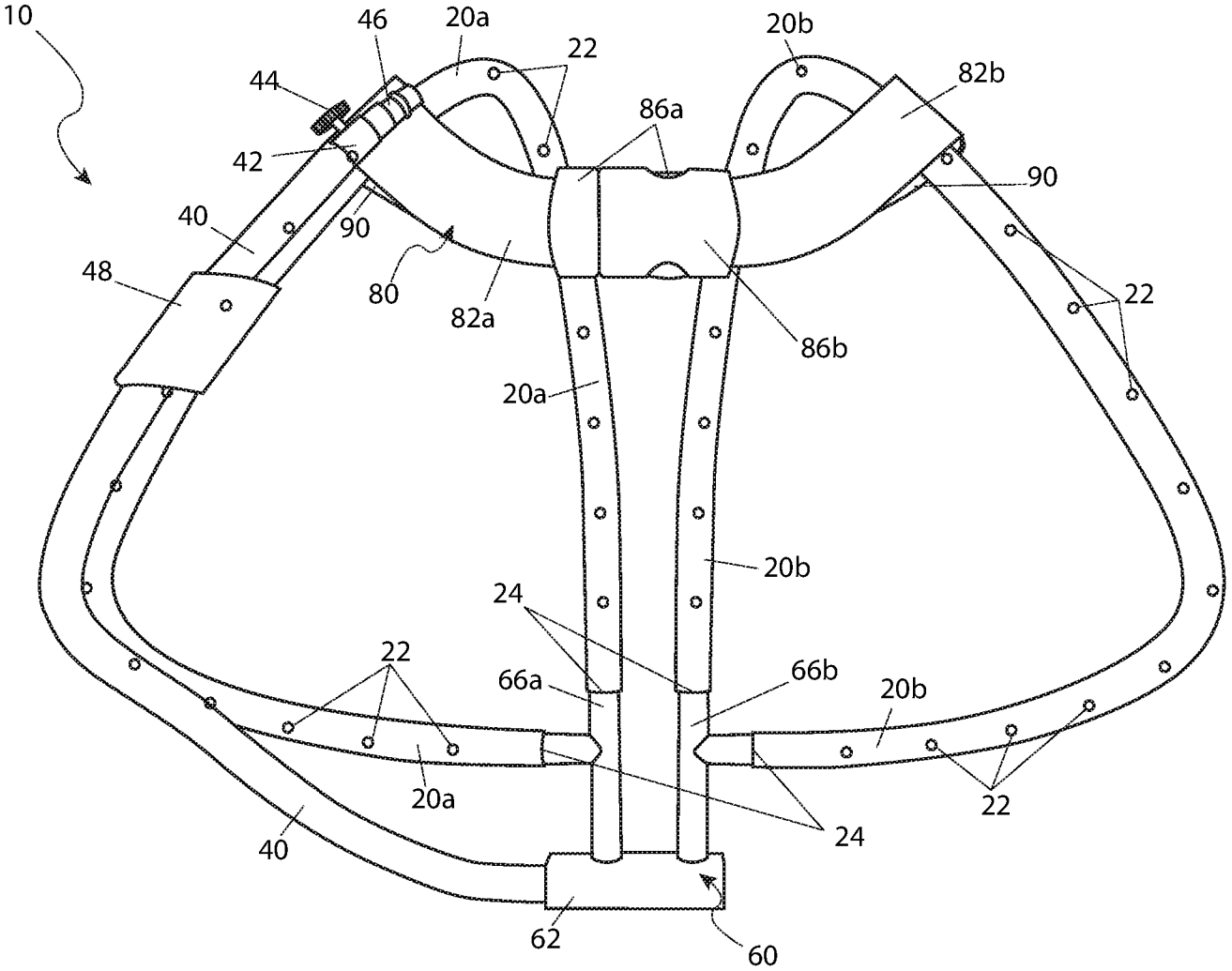
FIG. 2 is a front perspective view of the personal cooling apparatus 10 depicting removal of sleeve section portions 15*a*, 15*b*, according to a preferred embodiment of the present invention.

Each sleeve section 15*a*, 15*b* extends a length of a respective cooling tube 20*a*, 20*b* having its termination adjacent to a manifold portion 60 (see FIG. 2). Each sleeve section 15*a*, 15 also includes a means of detachment, removal, and cleaning via a seam 16 which runs all along a length of each sleeve section 15*a*, 15*b*, being joined via a hook-and-loop fastener portion 17 sewn all along the seam 16.

Referring now to FIG. 2, a front perspective view of the apparatus 10 depicting removal of the sleeve sections 15*a*, 15*b*, according to a preferred embodiment of the present invention, is disclosed. The apparatus 10 is illustrated here having the sleeve sections 15*a*, 15*b* removed for illustration sake. Each cooling tube 20*a*, 20*b* has a pair of tube ends 24 which are connected to a common manifold 60 located at the back of the user 100 near the beltline. The manifold 60 is in fluid communication with an existing air supply line 120 via a hose attachment end 45 of an interconnecting air hose 40 attachable to the air hose fitting 64 of the manifold 60. The air hose 40 includes valve 42 and adapter 46 portions. The adapter 46 provides a means of removable attachment of the air hose portion 40 of the apparatus 10 to an existing air supply line 120. The adapter 46 is envisioned to utilize standard quick-connect air coupling devices. The valve 42 includes a corresponding knob 44 to control the air flow 18 passing through the air hose 40 and into the manifold 60. A pressurized airflow 18 from the air supply line 120 passes through the air hose 40 and into the manifold 60, where integral portions of the manifold 60 including a first "T" fitting 66*a* and a second "T" fitting 66*b* provide distribution of the air flow 18 through the cooling tubes 20*a*, 20*b* via respective connections to the tube end portions 24 of the cooling tubes 20*a*, 20*b* (also see FIGS. 4*a*, 4*b*, and 4*c*).

The cooling tubes 20*a*, 20*b* are envisioned to take on a loop form and are positioned along back and side portions of the user 100 via an attached shoulder strap assembly 80 having an adjustable quick-release buckle 86*a*, 86*b* and being positioned across the user's 100 front shoulder and neck areas for convenient donning and removal.

Figure 3:
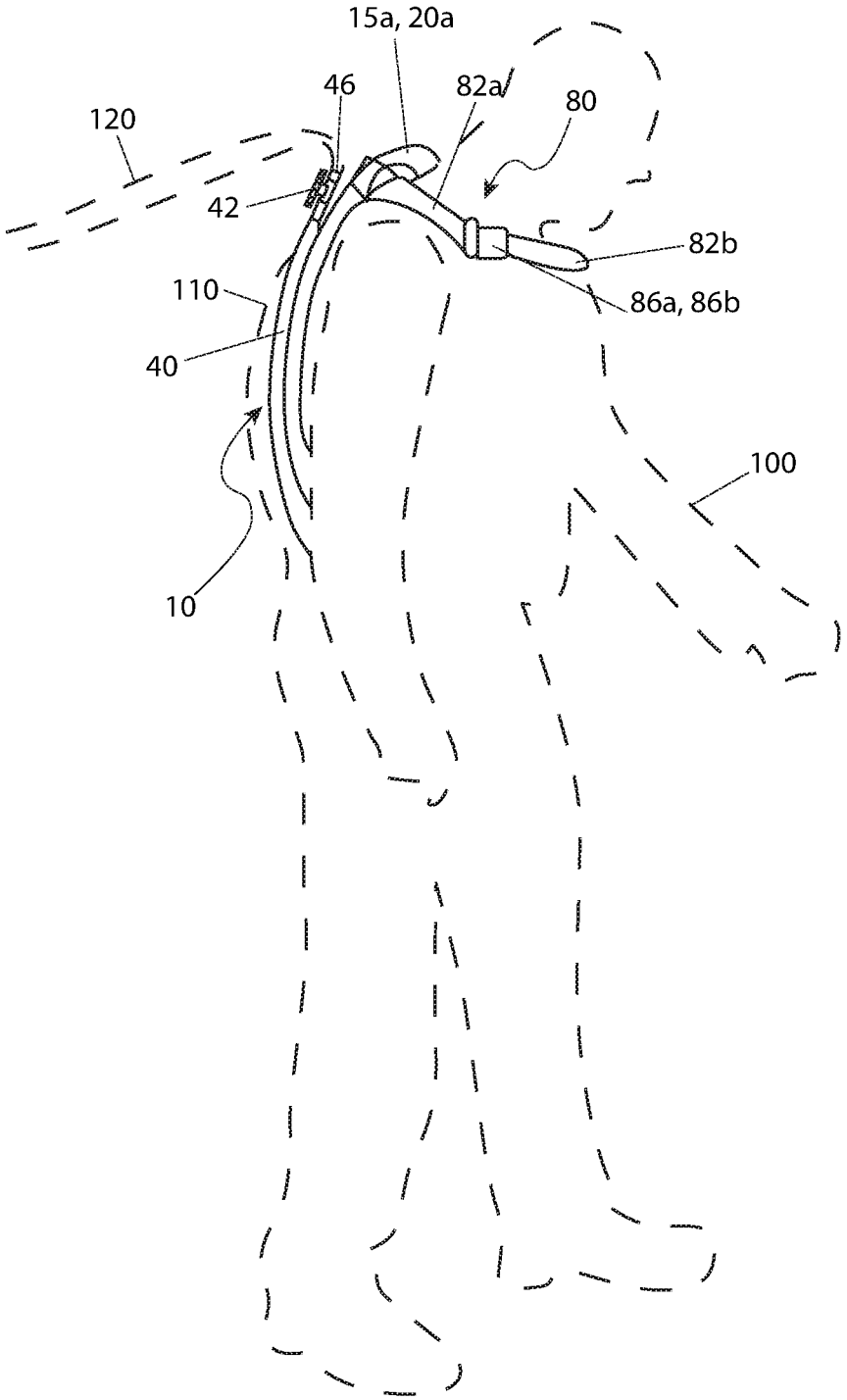
FIG. 3 is an environmental view of the apparatus 10, according to a preferred embodiment of the present invention.
Figure 4A:
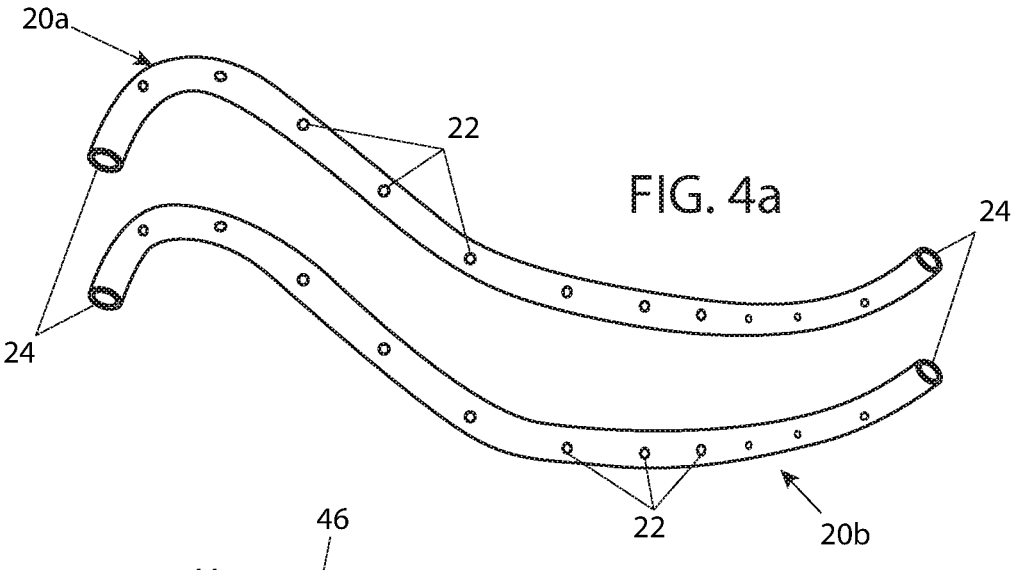
FIG. 4*a* is a perspective view of cooling tube portions 20*a*, 20*b* of the apparatus 10, according to a preferred embodiment of the present invention.
Figure 4B:
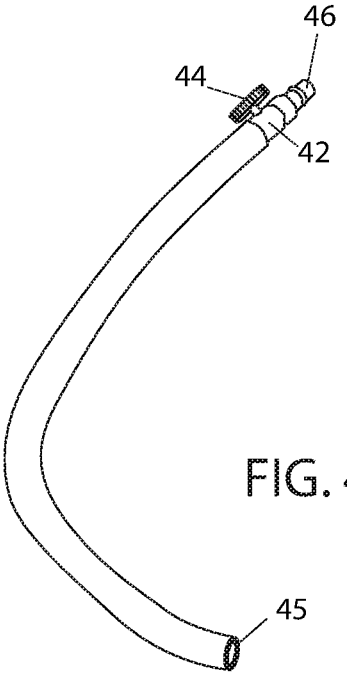
FIG. 4*b* is a perspective view of a supply hose portion 40 of the apparatus 10, according to a preferred embodiment of the present invention.
Figure 4C:
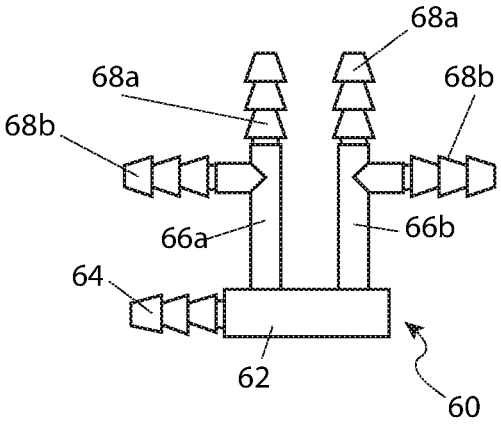
FIG. 4*c* is an isometric view of a manifold portion 60 of the apparatus 10, according to a preferred embodiment of the present invention; and, FIG. 4*d* is a perspective view of a shoulder strap portion 80 of the apparatus 10, according to a preferred embodiment of the present invention.
Figure 4D:
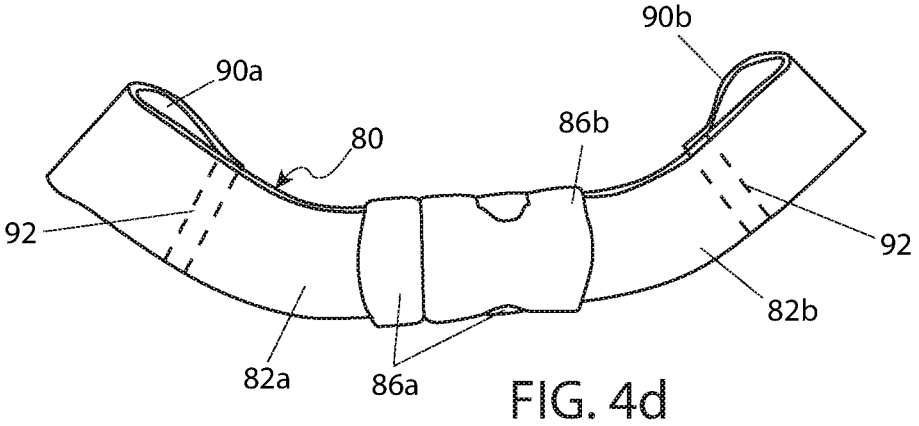

Referring now to FIG. 3, an environmental view of the apparatus 10, according to the preferred embodiment of the present invention, is disclosed. The cooling tubes portions 20*a*, 20*b* within the sleeve sections 15*a*, 15*b* are preferably positioned along back and side portions of a torso portion of the user 100 and beneath their outer garments 110. The features of the apparatus 10 allow a compressed air flow 18 to blow about the user's 100 torso area, thus keeping them cool. The air flow 18 from the apparatus 10 is also envisioned to provide shielding from possible harmful ambient fumes while performing certain operations such as gas metal arc welding, and the like.

Referring now to FIGS. 4*a*, 4*b*, 4*c*, and 4*d*, respective separated perspective views of the major portions of the apparatus 10 including the cooling tubes 20*a*, 20*b*, the supply hose 40, the manifold 60, and the shoulder strap 80, according to a preferred embodiment of the present invention, are disclosed. The cooling tubes 20*a*, 20*b* are envisioned to be made using similar lengths of a stock flexible plastic or rubber tubing having a plurality of equally-spaced tube apertures 22 being molded-in or punched through. The cooling tubes 20*a*, 20*b* are to be flexible and capable of conforming to the contours of various body shapes of the user 100.

Likewise, the air hose 40 is envisioned to be made of a similar material as the cooling tubes 20*a*, 20*b* but is envisioned to have a slightly greater inside diameter to provide sufficient flow of air to the two (2) cooling tubes 20*a*, 20*b*. The hose attachment end 45 is envisioned to be removably attached to the air hose fitting 64 via barbed fittings, or an equivalent hose connection means. A quick-connect air fitting adapter 46 exists at the other end portion to enable removable attachment to an existing air supply line 120. The valve 42 provides manual air flow control via adjustment of an integral knob 44, or similar means, to manually adjust or close the valve 42 as desired. It is envisioned that the air hose 40 be positioned adjacent to a neck area of the user 100 being affixed to either the first sleeve section 15*a* and first cooling tube 20*a*, or the second sleeve section 15*b* and second cooling tube 20*b*, using a compression wrap fastener 48 such as VELCRO® or equivalent means, thereby providing convenient positioning, attachment, and egress of the existing air supply line 120 from the apparatus 10 (also see FIG. 3).

The manifold 60 provides a unitary metal or plastic air conduit means having integral hollow portions including a body 62 which in turn includes protruding portions including an inlet air hose fitting 64, an outlet first "T" fitting 66*a*, and an outlet second "T" fitting 66*b*. Each "T" fitting 66*a*, 66*b* further provides a pair of barbed tube fittings 68*a*, 68*b*. Each first tube fitting 68*a* is in line with a respective outlet first or second "T" fitting 66*a*, 66*b* whereas each second tube fitting 68*b* is a perpendicular branch of a respective outlet first or second "T"-fitting 66*a*, 66*b*. The manifold 60 provides bifurcated adaption of a single inlet air hose fitting 64 into four (4) outlet tube fittings 68*a*, 68*b*, thereby providing connections to respective tube end portions 24 of the cooling tubes 20*a*, 20*b* (also see FIGS. 1 and 2). The air hose fitting 64 and tube fittings 68*a*, 68*b* are envisioned to include molded barbed-type hose connecting features or an equivalent means to securely attach the tubes 20*a*, 20*b* and air hose 40 portions to the manifold 60.

The shoulder strap 80 includes a first strap 82*a* and a second strap 82*b* being removably joined together along the user's 100 front shoulder and neck area preferably using a side-release-type buckle 86*a*, 86*b* made up of a first buckle portion 86*a* and an insertable second buckle portion 86*b*. Outwardly extending end portions of the straps 82*a*, 82*b* include respective sewn-in first strap loop 90*a* and a second strap loop 90*b* portions which provide an attachment means to respective cooling tubes 20*a*, 20*b* being inserted through the loops 90*a*, 90*b* (see FIG. 2). The loops 90*a*, 90*b* are formed by doubling back the straps 82*a*, 82*b* to form a loop, and then securing using stitching 92. The straps 82*a*, 82*b* are envisioned to be made using a stock strapping material such as nylon or an equivalent durable textile material.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 3.

The method of utilizing the apparatus 10 may be achieved by performing the following steps: procuring the apparatus 10; assembling the portions of the apparatus 10, if not previously assembled, by inserting the cooling tubes 20*a*, 20*b* into respective sleeve sections 15*a*, 15*b*; routing the cooling tubes 20*a*, 20*b* through the strap loop portions 90*a*, 90*b* of the straps 82*a*, 82*b*; connecting the tube end portions 24 of the cooling tubes 20*a*, 20*b* onto the tube fitting portions 68*a*, 68*b* of the manifold 60; connecting the air hose 40 to the barbed tube fitting portion 64 of the manifold 60; donning the apparatus 10 by positioning the cooling hose portions 20*a*, 20*b* against back and side torso portions of the user 100, and positioning the manifold 60 at a rear waistline area of the user 100; attaching the buckle portions 86*a*, 86*b* of the shoulder strap assembly 80 along the user's 100 front shoulder and neck areas; donning a user's 100 outer garments 110 in a normal fashion, over the apparatus 10; closing the valve 42 using the knob 44; connecting an existing pressurized air supply line 120 to the adapter 46; rotating the knob portion 44 of the valve 42 until obtaining a desired air flow 18 through the tube apertures 22 and into the user's 100 outer garments 110; performing tasks such as welding, in a normal manner while allowing the apparatus 10 to supply a continuous cooling air flow 18; and, benefiting from improved comfort while performing tasks associated with elevated temperatures, afforded a user 100 of the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

The invention claimed is:

1. A personal cooling apparatus, comprising:

a first cooling tube having a plurality of first apertures and a pair of first tube ends;

a second cooling tube having a plurality of second apertures and a pair of second tube ends;

a first sleeve removably attached about a circumference and an entire length of said first cooling tube;

a second sleeve removably attached about a circumference and an entire length of said second cooling tube;

a manifold having a first tee fitting and a second tee fitting attached on top of a body of the manifold, said first tee fitting in direct fluid communication with each of said pair of first tube ends and said second tee fitting in direct fluid communication with each of said pair of second tube ends;

an air hose in fluid communication with an air supply line, said air supply line in fluid communication with said manifold;

a valve in fluid communication with said air supply line, said valve includes a corresponding knob to control air flow passing through the air hose and into the manifold;

wherein the air hose is affixed to either the first sleeve section and the first cooling tube or the second sleeve section and the second cooling tube via a compression wrap hook and loop fastener, in such a manner that the air hose is adjacent to the neck area of the user; and an adapter in fluid communication with said valve;

an adjustable shoulder strap assembly removably attached to and spanning a distance between each said first cooling tube and said second cooling tube;

a removable attachment means for removably attaching a portion of said supply line to either one of said first or second cooling tubes;

wherein said first cooling tube and said second cooling tube are worn as a vest by a user;

wherein said adapter is in fluid communication with said air supply line such that an air flow is communicated from said air supply line through said plurality of first apertures and said plurality of second apertures; wherein said first sleeve and said second sleeve each comprise a mesh material;

wherein said plurality of first apertures are spaced equidistantly apart from each other along a length of said first cooling tube and said plurality of second apertures are spaced equidistantly apart from each other along a length of said second cooling tube; and wherein said first cooling tube, said second cooling tube, and said supply line are each flexible.

* * * * *